US010215019B2

(12) United States Patent
Martin et al.

(10) Patent No.: US 10,215,019 B2
(45) Date of Patent: Feb. 26, 2019

(54) INSTRUMENTED MULTILATERAL WELLBORES AND METHOD OF FORMING SAME

(71) Applicant: BAKER HUGHES INCORPORATED, Houston, TX (US)

(72) Inventors: Carl S. Martin, Houston, TX (US); Colin P. Andrew, Brampton (CA); Michael H. Johnson, Katy, TX (US); Joshua J. Kaufman, The Woodlands, TX (US); Luis E. Mendez, Houston, TX (US); David E. Schneider, Conroe, TX (US); Bryan P. Pendleton, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 269 days.

(21) Appl. No.: 15/089,948

(22) Filed: Apr. 4, 2016

(65) Prior Publication Data

US 2017/0284191 A1 Oct. 5, 2017

(51) Int. Cl.
*E21B 17/02* (2006.01)
*E21B 23/00* (2006.01)
(Continued)

(52) U.S. Cl.
CPC ..... *E21B 47/12* (2013.01); *E21B 17/028* (2013.01); *E21B 23/00* (2013.01); *E21B 23/04* (2013.01);
(Continued)

(58) Field of Classification Search
CPC ..... E21B 17/023; E21B 17/028; E21B 7/061; E21B 47/12
See application file for complete search history.

(56) References Cited

U.S. PATENT DOCUMENTS 9,175,560 B2 * 11/2015 Algeroy ..... E21B 47/122
2001/0025710 A1 * 10/2001 Ohmer ..... E21B 47/12 166/313

(Continued)

FOREIGN PATENT DOCUMENTS

WO 2016043737 A1 3/2016

OTHER PUBLICATIONS

PCT International Search Report and Written Opinion; International Application No. PCT/US2017/021242; International Filing Date: Mar. 8, 2017; dated May 31, 2017; pp. 1-12.

*Primary Examiner* — Jennifer H Gay
(74) *Attorney, Agent, or Firm* — Cantor Colburn LLP

(57) ABSTRACT

A method of completing a wellbore system that includes a main wellbore and a lateral wellbore intersecting the main wellbore at a junction is disclosed, wherein in one embodiment the method includes placing a first outer assembly below the junction in the main wellbore and placing a second outer assembly below the junction in the lateral wellbore; placing a first inner assembly in the second outer assembly with a top end thereof below the junction, the top end of the first inner assembly including a first wet connect associated with at least one link in the first inner assembly; and connecting a second wet connect of a string with the first wet connect with a top end of the string having a third wet connect corresponding to the at least one link above the junction in the main wellbore.

18 Claims, 4 Drawing Sheets

(51) Int. Cl.

| | |
|---|---|
| ***E21B 23/04*** | (2006.01) |
| ***E21B 47/00*** | (2012.01) |
| ***E21B 47/06*** | (2012.01) |
| ***E21B 47/10*** | (2012.01) |
| ***E21B 47/12*** | (2012.01) |

(52) U.S. Cl.
CPC ..... *E21B 47/00* (2013.01); *E21B 47/065* (2013.01); *E21B 47/10* (2013.01); *E21B 47/123* (2013.01)

(56) References Cited

U.S. PATENT DOCUMENTS

| | | | | |
|---|---|---|---|---|
| 2002/0125008 | A1* | 9/2002 | Wetzel | A45C 13/02 166/278 |
| 2003/0221829 | A1* | 12/2003 | Patel | A45C 13/02 166/278 |
| 2004/0149444 | A1* | 8/2004 | Cavender | E21B 41/0042 166/313 |
| 2011/0011580 | A1 | 1/2011 | Clark et al. | |
| 2013/0020088 | A1* | 1/2013 | Dyer | E21B 34/063 166/373 |
| 2013/0327572 | A1* | 12/2013 | Sponchia | E21B 41/0035 175/61 |
| 2017/0234113 | A1* | 8/2017 | Steele | E21B 41/0035 166/381 |
| 2017/0284191 | A1* | 10/2017 | Martin | E21B 47/12 |

* cited by examiner

INSTRUMENTED MULTILATERAL WELLBORES AND METHOD OF FORMING SAME

BACKGROUND

1. Field of the Disclosure

The disclosure relates generally to forming instrumented multi-lateral wells for the production of hydrocarbons from or injection of water into formation zones and monitoring various parameters of interest relating to the completion of such well and during production of hydrocarbons from such wells.

2. Background Art

Wells or wellbores are formed for the production of hydrocarbons (oil and gas) from subsurface formation zones where such hydrocarbons are trapped. Some wellbore systems include a main wellbore formed from a surface location and one or more lateral wellbores formed from the main wellbore initiating at selected depths in the main wellbore. Sometimes additional lateral wellbores (sub lateral wellbores) are formed from one or more of the lateral wellbores. Completion assemblies containing a variety of devices, such as packers, sliding sleeves, valves, screens, etc. are placed inside the main wellbore and the lateral wellbore for the production of hydrocarbons through such wellbores. A completion assembly typically includes an outer assembly or string and an inner assembly or string inside the outer assembly. An outer assembly typically includes packers, screens, sliding and sleeves while the inner assembly includes flow paths for the production of hydrocarbons from different zones, valves to control the flow from each zone into the inner assembly, etc. It is desirable to include sensors, both in the main wellbore and the lateral wellbore, to monitor various parameters of interest in each such wellbore and to control valves and other devices therein. It is therefore necessary to provide one or more links that run from the sensors in the wellbores to the surface. The links in a lateral wellbore will run from a location in the lateral wellbore through a junction between the main wellbore and the lateral wellbore to the main wellbore and then to the surface. The lateral wellbore may be an open hole or cased hole. Such wellbores are filled with a fluid during the placement of completion assemblies. It is therefore desirable to provide apparatus and methods for forming reliable connections to run the links from the lateral wellbore to the surface through the junction and the main wellbore in fluid filled wellbores.

The disclosure herein provides apparatus and methods for placing continuous links from a main wellbore and from a lateral wellbore intersecting the main wellbore at a junction to the surface to control devices in the main and lateral wellbores and to monitor various parameters of interests in each such wellbore. Such wellbores may provide fully instrumented lateral and/or main wellbores for monitoring the wellbores and for zonal control of multiple zones in each such wellbore.

SUMMARY

In one aspect, a method of completing a wellbore system that includes a main wellbore and a lateral wellbore intersecting the main wellbore at a junction is disclosed. The wellbore system in one non-limiting embodiment includes: placing a first outer assembly below the junction in the main wellbore and placing a second outer assembly below the junction in the lateral wellbore; placing a first inner assembly in the outer assembly in the lateral wellbore with a top end thereof having a first wet connection below the junction; providing a junction assembly having a second wet connection at a bottom end thereof and a third wet connection at a top end thereof; connecting the second wet connection to the first wet connection and placing the third wet connection in the min wellbore above the junction. Placing an inner string in the main wellbore and connecting the third wet connection to fourth wet connection of string deployed from a surface location. The completed system includes a first wet connect assembly in the lateral well bore and a second wet connect assembly in the main wellbore to provide a continuous link from the lateral wellbore to the surface.

In another aspect, a wellbore system is disclosed that in one non-limiting embodiment includes a main wellbore and a lateral wellbore formed from the main wellbore at a junction. The wellbore system, in one non-limiting embodiment, includes one or more links in the lateral wellbore linked to a control system at the surface. The link includes a wet mate connection assembly in the lateral wellbore below the junction and another wet mate connection assembly in the main wellbore above the junction. The link provides a two-way communication between sensors and circuits in the lateral wellbore to the surface control system and enables the surface control system to control selected devices in the lateral wellbore.

Examples of the more important features of an apparatus and methods have been summarized rather broadly in order that the detailed description thereof that follows may be better understood, and in order that the contributions to the art may be appreciated. There are, of course, additional features that will be described hereinafter and which will form the subject of the claims.

DRAWINGS

For a detailed understanding of the apparatus and methods disclosed herein, reference should be made to the accompanying drawing and the detailed description thereof, wherein like elements are generally given same numerals and wherein.

Figure 2:
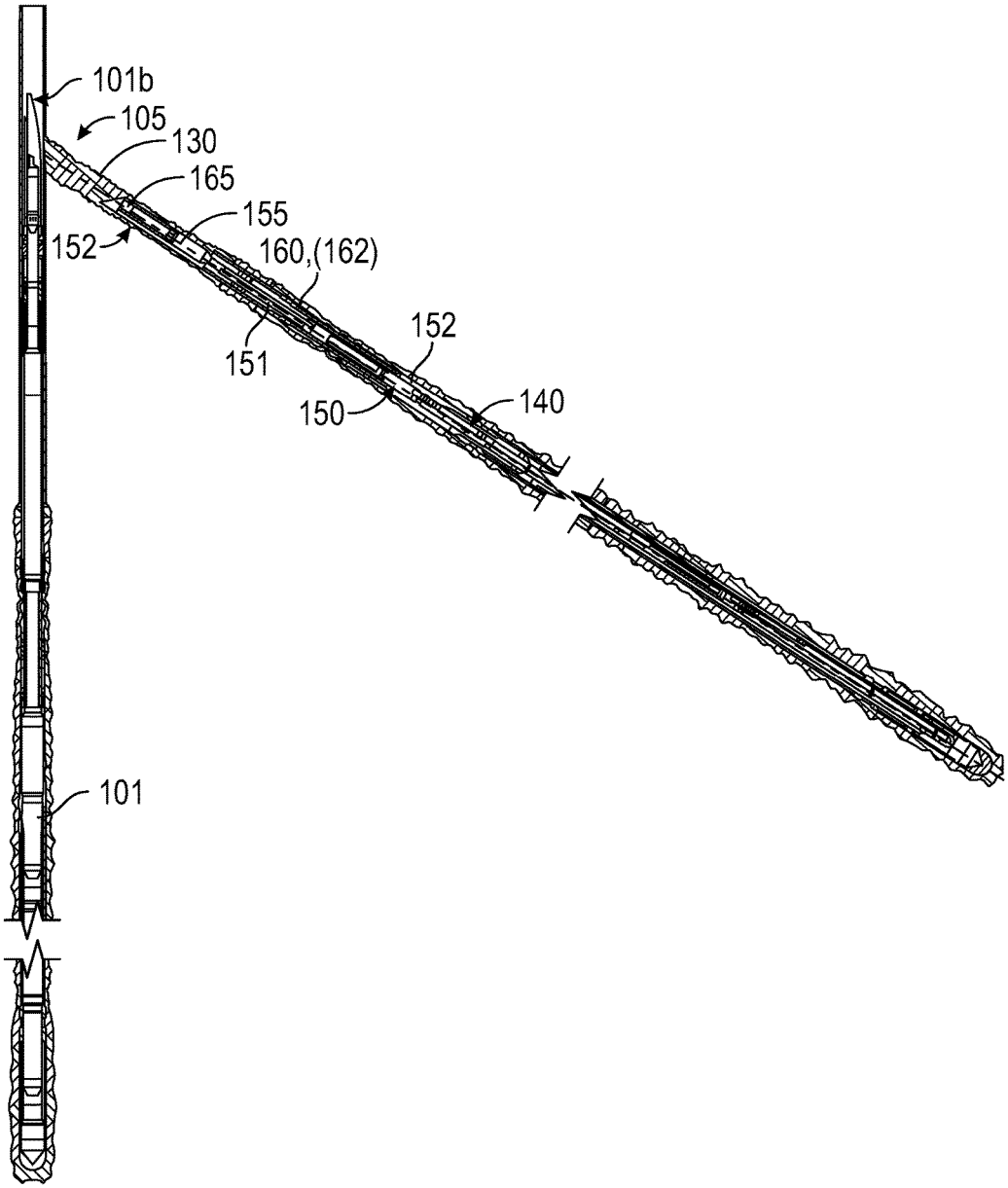
FIG. 2 shows the wellbores of FIG. 1, wherein an inner completion assembly has been placed inside the second lower outer completion assembly in the lateral wellbore and wherein the top end of the inner lateral completion assembly includes a first wet connection below the junction.
Figure 3:
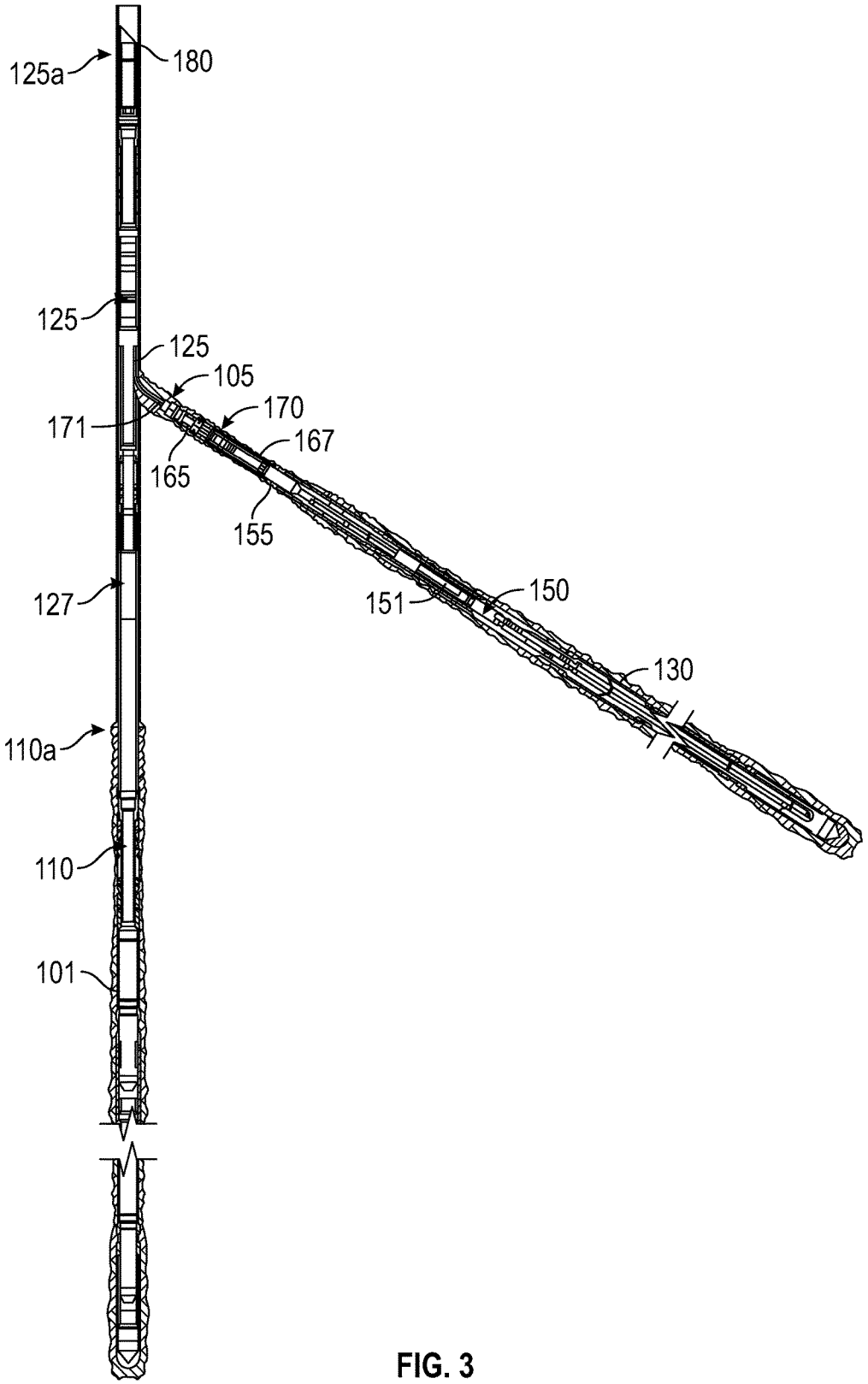
Figure 4:
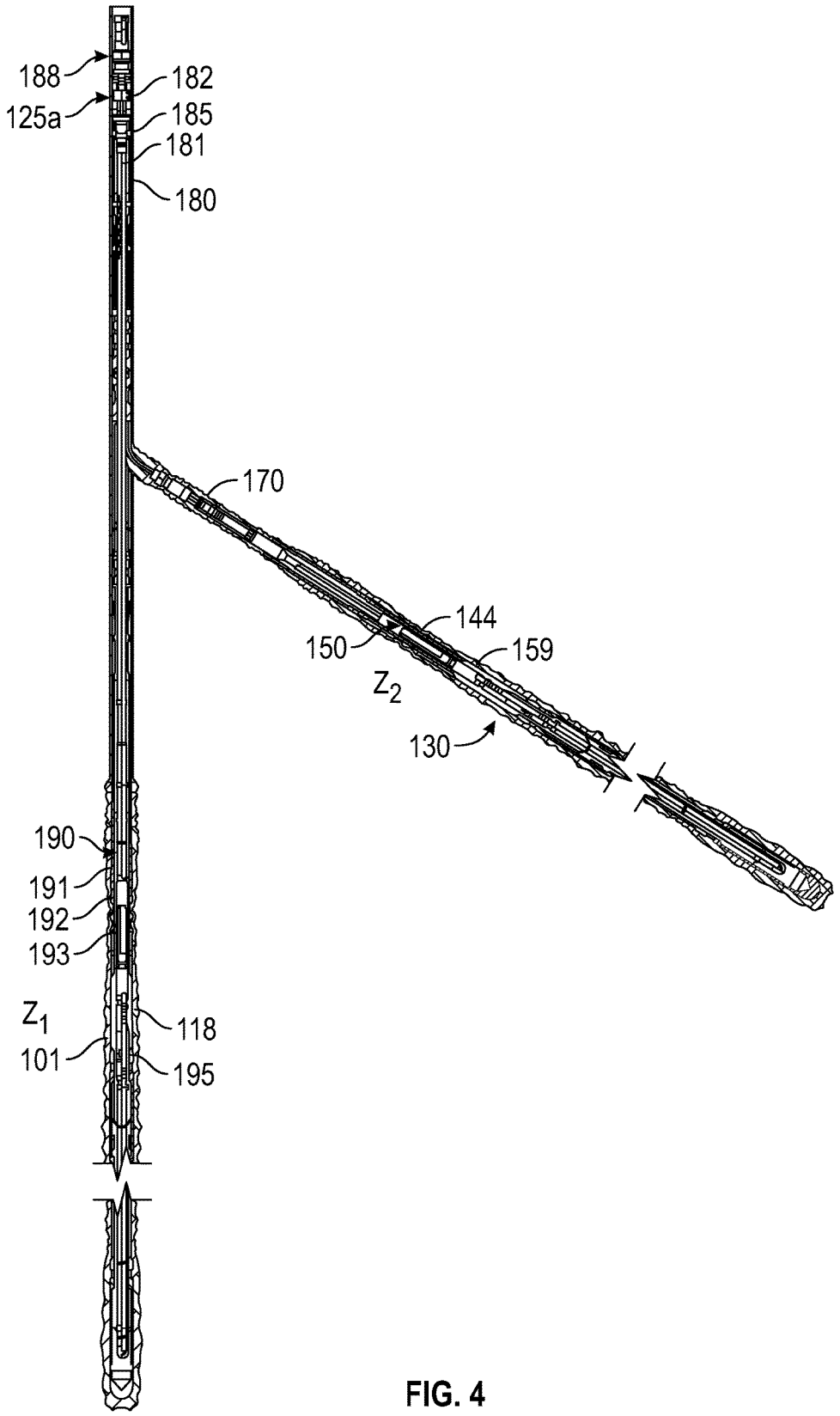

FIG. 3 shows the wellbores of FIG. 2 wherein a string having a second wet connection at its bottom end has been connected to the first wet connection in the lateral wellbore and wherein a third wet connection at the top end of the string has been placed in the main wellbore above the junction; and FIG. 4 shows the wellbore system of FIG. 3, wherein an inner completion assembly has been placed in the outer completion assembly in the main wellbore at a fourth wet connection has been connected to the third wet connection to provide a continuous link from the lateral wellbore to the surface.

DETAILED DESCRIPTION

Figure 1:
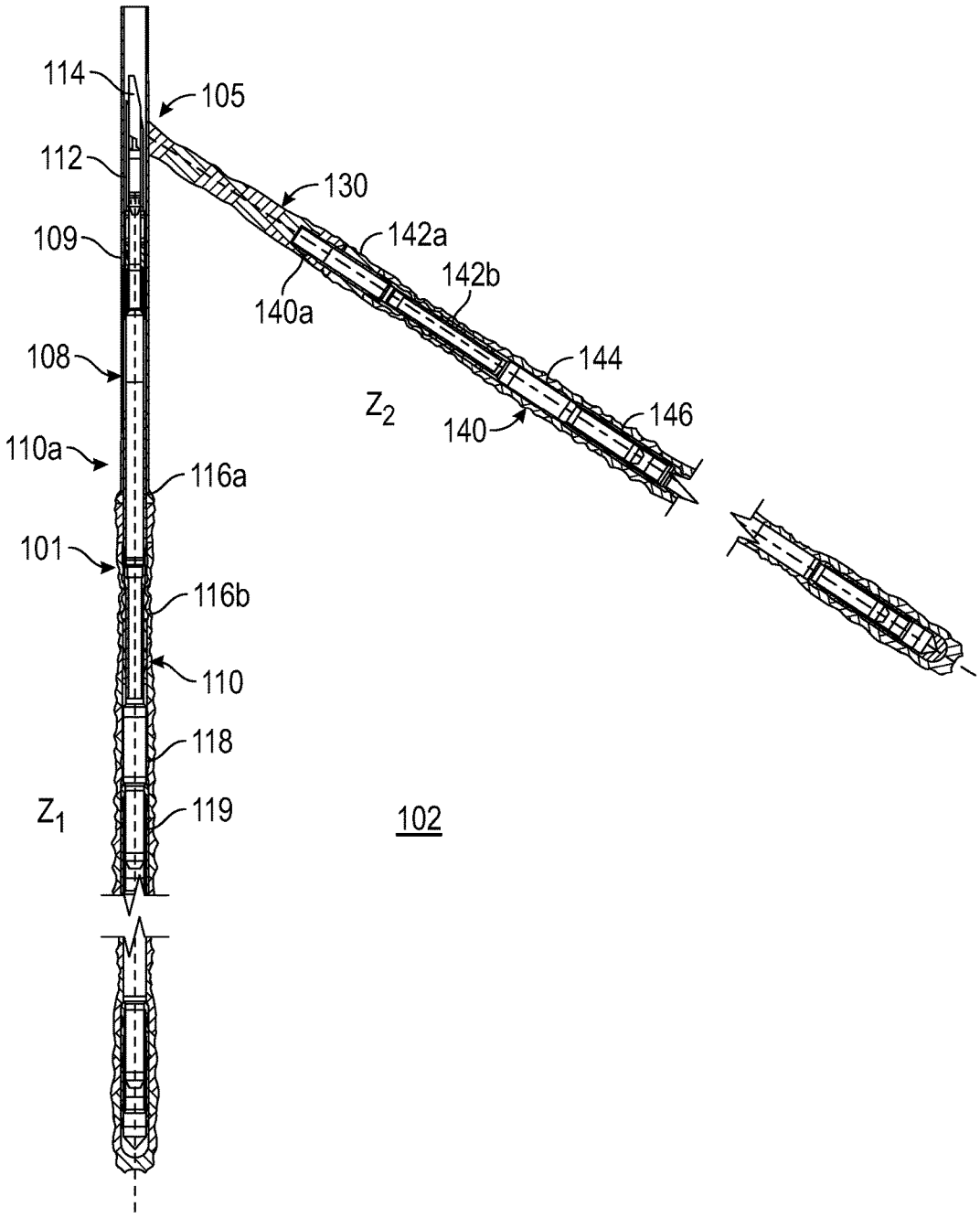
FIG. 1 shows a main wellbore and a lateral wellbore that have been formed from the main wellbore at a junction and wherein a first lower outer completion assembly has been placed in the main wellbore and a second lower outer completion assembly has been placed in the lateral wellbore via a diverter at the junction.

FIG. 1 shows a main wellbore 101 formed in a formation 102 and a lateral wellbore 130 formed from the main wellbore 101 at a junction 105. The main wellbore 101 is shown with a lower or outer completion assembly or string 110 placed therein with its upper end 110*a* below the junction 105. An anchor 108, an excluder sub 109 and a combination seal and bore diverter 112 ("diverter") are placed in that order above the upper end 110*a* of the lower completion assembly 110. The diverter 112 includes an inclined member 114 that enables apparatus, such as a completion assembly, a production assembly or another string, conveyed from a location into the main wellbore 101 to pass into the lateral wellbore 130. The lower completion assembly 110 may include any desired apparatus for performing desired wellbore operations, including, but not limited to, packers for isolating zones, such as zone $Z_1$, sliding sleeves or other valves for supplying fluid into the zones for fracturing operations, flowing fluid from the zones into the lower completion assembly 110, and sensors for providing information about various parameters of interest, including, but not limited to, pressure, temperature, flow, vibration, corrosion and abrasion.

Still referring to FIG. 1, the exemplary lower completion assembly 110 is shown to include packers 116*a* and 116*b* to isolate or provide a seal between the lower completion assembly 110 and the wellbore 101, a screen 118 to prevent flow of certain solid particles from the formation 102 into the lower completion assembly 110, a frac sleeve 119 to supply fracturing fluid supplied from the surface into a selected zone Z1 in the formation 102, etc. Any number of other desired devices may be placed in the lower completion assembly 110. The lateral wellbore 130 is shown with a lower completion assembly 140 with its upper end 140*a* below the junction 105. The exemplary lower completion assembly 140 is shown to include packers 142*a* and 142*b*, screen 144 and frac sleeve 146 adjacent a production zone $Z_2$. A variety of lower completions assemblies and methods of installing such assemblies in wellbores are known and different assemblies are used depending upon the desired wellbore system and are thus not described herein in detail. Any suitable lower completion assembly may be utilized for the purpose of this disclosure. At this stage, a first well 101 includes a lower completion assembly or string 110 with a diverter at the junction 105, while a second wellbore 130 that intersects with the first wellbore 101 at junction 105 includes an outer assembly 140. The wellbore 130 and the junction 105 are shown to be open holes, i.e., without any casing in the junction 105 or the wellbore 130. At this stage, the wellbores 101 and 130 are ready for performing certain wellbore operations, including, but not limited to, setting of packers, fracturing zones Z1 and Z2, etc.

Once the completion operations have been performed in the wellbores 110 and 130, these wellbores are ready for the installation of production assemblies (also referred to herein as inner assemblies or strings) for the production of hydrocarbons from various zones, such as zones $Z_1$ and $Z_2$, controlling various downhole devices such as valves and monitoring of various downhole parameters of interest from the downhole sensors, including, but not limited to, pressure, temperature, flow rate, corrosion, abrasion and vibration, as described later. FIG. 2 shows wellbore 130 after an inner assembly or production assembly 150 has been placed inside the outer assembly 140 to a location below the junction 105. The inner assembly 150 includes devices, such as valve 152, monitoring gauges or sensors 160 and a link 155, which may include one or more individual links or lines 151. Sensors may include, but are not limited to, temperature sensors, pressure sensors and flow measurement sensors. The links 151 may control one or more devices, such as valves, and receive information from the sensors 160 and provide communication with a surface control and monitoring apparatus, including a computer-based control unit (not shown). The links 151 terminate at a wet mate (also referred to as a "wet connect") 165 at the top end 152 of the inner assembly 150. The wet connect 165 includes a connection or terminal for each of the individual links 156 included in the link 155. The connections for links 151 in the wet connect 165 may be male or female connections. Such wet connections can be mated with their mating counterparts in wellbores filled with a fluid. The inner assembly 150 is conveyed from the surface into the upper portion 101*b* of the wellbore 101, which is diverted at the junction 105 into the lateral wellbore 130 and placed inside the lower completion assembly 140. Links 151 may include electrical lines (conductors), fiber optic lines and hydraulic lines. Links 151 are connected to sensors 160 and their associated electrical circuits (collectively denoted by numeral 162) to transfer power to such sensors and circuits and to receive sensor data and to provide two-way communication between sensors 160 and circuits 162 and a surface control unit (not shown), which may be a computer-based system. Links 151 also are coupled to various devices, such as valves 152 to control the operations of such devices. At this stage, the inner upper end 152 of the completion assembly 150 and the wet connect 165 is exposed to the fluid in the wellbore 130 below the junction 105 and is ready for connection to an assembly in the main wellbore 101 as described below.

FIG. 3 shows the wellbores 101 and 130 of FIG. 2, wherein a wet connect 167 at a bottom of an assembly 125 conveyed from the main wellbore 101 has been mated with the wet connect 165 of the inner assembly 150 to provide a connection path for the links 151 in the lateral wellbore 130 to the main wellbore 101 through the open hole junction 105. The mated wet connects 165 and 167 are referred herein as wet mate assembly 170. The assembly 125 includes a separate link 171 corresponding to each of the links 151. The links 171 terminate at a wet connect 180 in the main wellbore 101 above the junction 105. The wet connect 180 thus includes a connection corresponding to each link 151 in the inner assembly 150 in the lateral wellbore 130. At this stage, the links 155 run from the lateral wellbore 130 to a location in the main wellbore 101 above the junction 105. The assembly 125 also includes a string 127 that is connected to the upper end 110*a* of the lower completion assembly 110 in the main wellbore 101. The assemblies 110 and 125 provide a continuous assembly from the bottom of the wellbore 101 to an upper end 125*a* of the assembly 125 located above the junction 105 in the main wellbore 101. At this stage wellbore 101 is ready for the installation of an inner or production assembly there and for the placement of an upper assembly extending from location 125*a* above the junction to the surface for the production of hydrocarbons from wellbores 101 and 130 as described below.

Referring to FIG. 4, an upper completion assembly 188 conveyed from the surface is coupled to the upper end 125*a* of the assembly 125 that also connects a wet mate 182 at the bottom end of the assembly 188 to the wet mate 180. The mated wet mates 180 and 182 provide a wet mate assembly 185. The wet mate 182 includes a separate connection and link 181 corresponding to each link 171. Thus, links 151, 171 and 181 provide continuous links from the lateral wellbore 130 to the surface. An inner production assembly 190 is conveyed from the surface into the lower completion assembly 110 in the main wellbore 101. The inner production assembly 190 includes links 191 coupled to various sensors 192 and devices 193 in the inner production assembly 190. Links 191 provide continuous connections between sensors 192 and devices 193 and the surface in the wellbore system shown in FIG. 4. Fluid from production zones in the main wellbore 101, such as zone Z1, flows to the surface via screen 118 and valve 195 in the production string 190. Fluid from lateral wellbore zone Z2 flows to the surface via screen 144, valve 159, the production assembly 150 and then the production assembly 190 to the surface.

Thus, in the exemplary well system shown in FIGS. 1-4 includes a first wet mate assembly or carrier 170 in the lateral wellbore 130 that includes an open hole wet mate connection 165 and a feed through connection 167 that mates with connection 165; and a second wet mate assembly or carrier 185 in the main wellbore that includes a wet mate 180 and a mating feed though connection 187 to provide continuous links (151, 171, 181) from the lateral wellbore 130 to the surface. Also, continuous links 191 run from the main wellbore to the surface in the inner production assembly 190 in the main wellbore. Such a system allows for the monitoring and control of the main wellbore and each zone in the lateral wellbore.

The foregoing disclosure is directed to certain exemplary non-limiting embodiments. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A method of completing a first wellbore and a second wellbore intersecting the first wellbore at a junction; the method comprising:
   - placing a first outer assembly below the junction in the first wellbore and placing a second outer assembly below the junction in the second wellbore;
   - extending a first inner assembly into a central bore of the second outer assembly, a top end of the first inner assembly positioned below the junction, the top end of the first inner assembly including a wet connect associated with at least one link in the first inner assembly;
   - connecting a wet connect of an assembly with the wet connect of the first inner assembly, wherein the assembly includes a string extending into the first wellbore; and
   - connecting the string of the assembly to the first outer assembly in the first wellbore.

2. The method of claim 1 further comprising:
   - conveying a second inner assembly through the assembly and into the first outer assembly.

3. The method of claim 2, wherein the first inner assembly includes at least one sensor coupled to the at least one link.

4. The method of claim 3 further comprising monitoring an operation of the second wellbore in response to measurements provided by the at least one sensor in the second wellbore.

5. The method of claim 4, wherein the measurement is selected from a group consisting of: temperature; pressure; and flow rate; vibration; abrasion; and corrosion.

6. The method of claim 1, wherein the first inner assembly includes at least one sensor for determining a parameter of interest relating to a downhole operation in the second wellbore.

7. The method of claim 6, wherein the at least one link includes one of: an electrical conductor; a fiber optic link; and a hydraulic line.

8. The method of claim 6, wherein the parameter of interest is selected from a group consisting of: pressure; temperature, flow rate; vibration; abrasion and corrosion.

9. The method of claim 1 further comprising fracturing a zone in one of the first wellbore and the second wellbore before placing the first inner assembly in the second wellbore.

10. The method of claim 1, wherein the junction is an open hole junction extending from a first selected location below the junction in the second wellbore to a second selected location above the junction in the first wellbore.

11. A wellbore system having a lateral wellbore formed from a main wellbore at a junction thereof, the wellbore system comprising:
   - an outer assembly in the lateral wellbore with a top end thereof below the junction in the lateral wellbore and an inner assembly extending into a central bore of the outer assembly in the lateral wellbore, wherein the inner assembly includes a top end that has a wet connect corresponding to a link in the inner assembly below the junction; and
   - an assembly having a wet connect at a lower end connected to the wet connect of the inner assembly in the lateral wellbore, and a string extending to an outer assembly in the main wellbore below the junction.

12. The wellbore system of claim 11 further comprising a production assembly extending from a surface location through the assembly and into the outer assembly in the main wellbore.

13. The wellbore system of claim 12, wherein the inner assembly in the lateral wellbore includes a sensor for determining a parameter of interest relating to the lateral wellbore.

14. The wellbore system of claim 13, wherein the link includes one of: an electrical conductor; a fiber optic link; and a hydraulic line.

15. The wellbore system of claim 13, wherein the parameter of interest is selected from a group consisting of: pressure; temperature, flow rate; vibration; abrasion; and corrosion.

16. The wellbore system of claim 12 further comprising a sensor in the lateral wellbore for providing information relating to a parameter of interest in the lateral wellbore.

17. The wellbore system of claim 12 further comprising a controller that controls a device in the second wellbore via the continuous link.

18. The wellbore system of claim 11, wherein the junction is an open hole junction extending from a first location below the junction in the second wellbore to a second location above the junction in the first wellbore.

* * * * *